US010822853B2

(12) United States Patent
Yu

(10) Patent No.: US 10,822,853 B2
(45) Date of Patent: Nov. 3, 2020

(54) CAM TYPE DOOR CLOSER

(71) Applicant: SUN-Q DOOR CONTROLS LIMITED, Yuanlin (TW)

(72) Inventor: Shun-Hsien Yu, Yuanlin (TW)

(73) Assignee: SUN-Q DOOR CONTROLS LIMITED, Yuanlin, Changhua County (TW)

( * ) Notice: Subject to any disclaimer, the term of this patent is extended or adjusted under 35 U.S.C. 154(b) by 0 days.

(21) Appl. No.: 16/415,129

(22) Filed: May 17, 2019

(65) Prior Publication Data

US 2020/0308890 A1 Oct. 1, 2020

(30) Foreign Application Priority Data

Mar. 29, 2019 (TW) ..... 108111304 A

(51) Int. Cl.
*E05F 3/10* (2006.01)
*E05F 3/22* (2006.01)

(52) U.S. Cl.
CPC ..... *E05F 3/224* (2013.01); *E05F 3/104* (2013.01); *E05F 3/223* (2013.01);
(Continued)

(58) Field of Classification Search
CPC ..... E05F 1/1253; E05F 1/1246; E05F 1/129; E05F 3/104; E05F 3/10; E05F 3/20; E05F 3/225; E05F 3/227; E05Y 2201/638; E05Y 2800/268; E05Y 2900/132; E05Y 2600/452; E05Y 2600/41; E05D 7/04; E05D 7/081; E05D 7/084; E05D 7/086; E05D 7/10; E05D 11/104; E05D 11/1064; Y10T 16/552; Y10T 16/5525; Y10T 16/56; Y10T 16/593; Y10T 16/2769; Y10T 16/2771; Y10T 16/2774; Y10T 16/283;
(Continued)

(56) References Cited

U.S. PATENT DOCUMENTS 4,658,468 A * 4/1987 Tillmann ..... E05F 3/104 16/53
5,417,013 A * 5/1995 Tillmann ..... E05F 3/104 16/53

(Continued)

FOREIGN PATENT DOCUMENTS

DE 4239219 A1 * 5/1994 ..... E05F 3/104
TW I495780 B 8/2015

*Primary Examiner* — Chuck Y Mah
(74) *Attorney, Agent, or Firm* — Muncy, Geissler, Olds & Lowe, P.C.

(57) ABSTRACT

A cam type door closer includes a housing, a first piston set mounted in one side of the housing, a second piston set mounted in the other side of the housing, which includes a second piston movably mounted in a shaft hole of a first piston of the first piston set, a gap compensation device mounted in the second piston, a second spring having one end thereof stopped against the second piston and a security and sealing cap mounted in the housing to stop the other end of the second spring, and a drive shaft assembly rotatably mounted in a longitudinal passage of housing, which includes a shaft and an eccentric cam mounted on the shaft with one side thereof stopped against a roller of the first piston set and an opposite side thereof stopped against the second piston.

7 Claims, 8 Drawing Sheets

(52) U.S. Cl.
CPC ..... *E05Y 2201/456* (2013.01); *E05Y 2201/47* (2013.01); *E05Y 2201/638* (2013.01); *E05Y 2201/682* (2013.01); *E05Y 2201/688* (2013.01); *E05Y 2201/706* (2013.01); *E05Y 2800/298* (2013.01); *E05Y 2900/132* (2013.01)

(58) Field of Classification Search
CPC ..... Y10T 16/304; Y10T 16/53826; Y10T 16/53836; Y10T 16/5384; Y10T 16/53848
See application file for complete search history.

(56) References Cited

U.S. PATENT DOCUMENTS 5,829,097 A * 11/1998 Toledo ..... E05C 17/26 16/53
5,901,412 A * 5/1999 Jentsch ..... E05F 3/104 16/53
8,528,169 B1 * 9/2013 Yu ..... E05D 7/043 16/238
8,578,556 B1 * 11/2013 Yu ..... E05F 3/227 16/240
9,095,214 B2 * 8/2015 White ..... E05F 1/1253
9,181,744 B2 * 11/2015 Salutzki ..... E05F 3/104
9,631,412 B2 * 4/2017 Hellwig ..... E05F 3/22
9,790,723 B2 * 10/2017 Bienek ..... E05F 3/16
2005/0177975 A1 * 8/2005 Wang ..... E05F 3/04 16/60
2007/0033768 A1 * 2/2007 Ginzel ..... E05F 3/04 16/71
2008/0092447 A1 * 4/2008 Bienek ..... E05F 15/53 49/340
2012/0117755 A1 * 5/2012 Walhorn ..... E05F 3/104 16/66
2012/0272475 A1 * 11/2012 Bienek ..... E05F 3/104 16/51
2013/0081227 A1 * 4/2013 Hensh ..... E05F 3/104 16/53
2013/0185896 A1 * 7/2013 Yu ..... E05F 3/226 16/55
2015/0143663 A1 * 5/2015 Hellwig ..... E05F 3/104 16/52
2015/0176319 A1 * 6/2015 Huang ..... E05F 1/105 16/80

* cited by examiner

CAM TYPE DOOR CLOSER

BACKGROUND OF THE INVENTION

1. Field of the Invention

The invention relates to a door closer, in particular to a cam type door closer capable of compensating for a gap, which can stabilize the closing speed of the door by a compensation design of the piston during the closing process.

2. Description of the Related Art

In Taiwan Patent No. 1495780, a conventional door closer is used to assist the door to be slowly and automatically closed after being opened, thereby maintaining the stability and closed state of the indoor environment.

However, for a long time, conventional door closers mostly emphasize the change of the closing speed, the design that can adjust the strength of the damping resistance to conform to the traveling speed when the door is closed, or the placement a fireproof design in the valve body. If it encounters a sudden fire, the fireproof design can automatically start to close the door to prevent the fire from spreading further to reduce the danger range. With the development and improvement of the door closer manufacturers over the years, the convenience and safety of the above-mentioned door closers have also improved. In other words, the practicality and safety of today's door closers are mature and stable. However, the pistons of conventional door closers cannot provide a fixed axis (or eccentric cam) with a timely resistance between 90 degrees and 75 degrees. Therefore, when the door is turned from the open state to the closed state, the door will have a non-resistance or uncontrolled condition between 90 degrees and 75 degrees, which may cause the door closer to be unstable or even cause internal components to be damaged. Therefore, conventional door closers are still not satisfactory in function, and need to be improved.

SUMMARY OF THE INVENTION

The present invention has been accomplished under the circumstances in view. It is the main object of the present invention to provide a cam type door closer, which has the effect of controlling the closing speed of the glass door in the whole process and has the advantage of positioning the glass door at a predetermined pivot angle.

To achieve this and other objects of the present invention, a cam type door closer comprises a housing, a first piston set, a second piston set, and a drive shaft assembly. The housing comprises an axial passage and a longitudinal passage in communication with the axial passage. The axial passage extends perpendicular to the longitudinal passage and runs through two opposite sides of the housing. The first piston set is mounted in the axial passage of the housing, comprising a first piston, a roller, a plug pin, a first spring and a first sealing cap. The first piston comprises an open chamber, a shaft hole and an elongated slot respectively disposed in communication with each other. The open chamber is located in a middle part of the first piston. The shaft hole is located in a distal end of the first piston. The elongated slot is disposed above the open chamber. The first spring is mounted in the axial passage of the housing with one end thereof stopped against the first piston and an opposite end thereof stopped against the first sealing cap. The first sealing cap is mounted in the housing to seal one end of the axial passage. The second piston set is mounted in the axial passage of the housing, comprising a second piston, a gap compensation device, a second spring and a second sealing cap. The second piston is movably mounted in the shaft hole of the first piston, comprising a large diameter passage and a small diameter passage in communication with each other. The gap compensation device is mounted in the large diameter passage of the second piston. The second spring is mounted in the axial passage of the housing with one end thereof stopped against the second piston and an opposite end thereof stopped against the second sealing cap. The second sealing cap is mounted in the housing to seal an opposite end of the axial passage. The drive shaft assembly is rotatably inserted into the longitudinal passage of the housing, comprising a shaft and an eccentric cam. The eccentric cam is located on the shaft with one side thereof stopped against the roller of the first piston set and an opposite side thereof stopped against the second piston of the second piston set.

Preferably, the housing further comprises a recess located above the longitudinal passage. The shaft comprises a latching segment, a connecting segment and a transition segment between the latching segment and the connecting segment. The eccentric cam is mounted on the shaft between the transition segment and the connecting segment within the open chamber of the first piston. The connecting segment of the shaft is inserted through the elongated slot of the first piston into the recess of the housing.

Preferably, the drive shaft assembly further comprises an upper bushing, a gasket and a lower bushing set. The upper bushing and the gasket are mounted in said recess of the housing. The connecting segment of the shaft is inserted into the upper bushing. The lower bushing set is mounted on the transition segment of the shaft to enhance the pivoting smoothness of the drive shaft assembly.

Preferably, the gap compensation device of the second piston set comprises a locating ring, a sleeve, a plug, an elastic member and a locating pin. The locating ring is threaded into the large diameter passage of the second piston. The sleeve comprises a sleeve body and a flange at a distal end of the sleeve body. The sleeve body is inserted into the locating ring. The flange is stopped at an end edge of the locating ring. The sleeve body of the sleeve comprises an accommodating space and a small passage coaxially communicated with each other. The plug and the elastic member are sequentially mounted in the accommodating space of the sleeve body. The plug has one end thereof facing toward the small passage of the sleeve body and an opposite end thereof stopped against the elastic member. The locating pin is inserted into the sleeve body to pass through the accommodating space for stopping the elastic member. It is used to adjust the fuel supply of the hydraulic piston so as to improve the opening and closing quality and control the closing speed.

Preferably, the eccentric cam comprises two positioning grooves. One positioning groove is adapted for stopping against the roller of the first piston set when the housing is biased to a first predetermined pivot angle. The other positioning groove is adapted for stopping against the second piston of the second piston set when the housing is biased to a second predetermined pivot angle. In this way, the user can open the door to a predetermined angle, and at the same time, can control the speed of closing the door to increase the practicality of the cam type door closer.

Preferably, the eccentric cam comprises a concave arc portion adapted for stopping against the second piston of the second piston set when the housing is biased to a third predetermined pivot angle.

Preferably, the cam type door closer further comprises a locating block. The locating block comprises a mounting plate, a plurality of adjusting members and an adjustment plate. The mounting plate is affixed to the floor. The mounting plate comprises an accommodation chamber, and a plurality of adjusting holes on a peripheral wall thereof in communication with the accommodation chamber. The adjusting members are respectively movably mounted in the adjusting holes. The adjustment plate is mounted in the accommodation chamber of the mounting plate and connected to the shaft of the drive shaft assembly and stoppable by the adjusting members to move relative to the mounting plate in adjusting the deviation of the door so that the door can be accurately closed.

Therefore, when the user closes the glass door, the first spring of the first piston set and the second spring of the second piston set will each provide a moderate pressure to the first piston and the second piston against the roller and the second piston and provides resistance to the eccentric cam of the drive shaft assembly in the whole door closing process, so that the closing speed of the glass door can be controlled at all times, which can reduce the damage of the internal components of the door closer.

Other advantages and features of the present invention will be fully understood by reference to the following specification in conjunction with the accompanying drawings, in which like reference signs denote like components of structure.

DETAILED DESCRIPTION OF THE INVENTION

Figure 1:
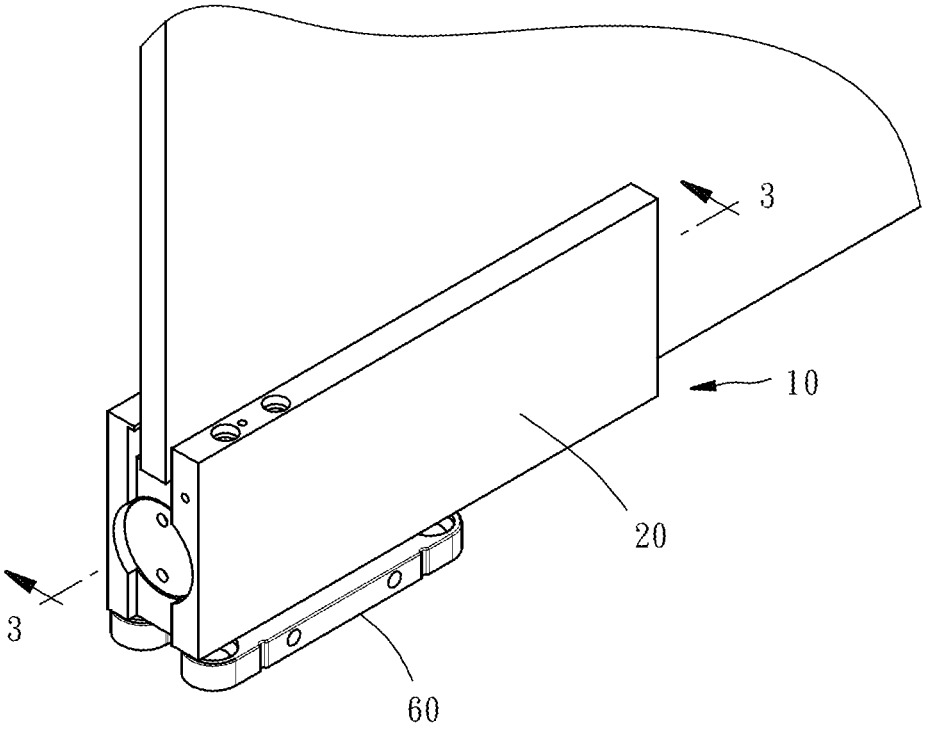
FIG. 1 illustrates a cam type door closer installed in a glass door in accordance with the present invention.

The applicant first describes here, throughout the specification, including the preferred embodiment described below and the claims of the scope of the present application, the nouns relating to directionality are based on the direction in the schema. In the following preferred embodiment and the drawings, the same reference numerals are used to refer to the same or similar elements or structural features thereof.

Figure 2:
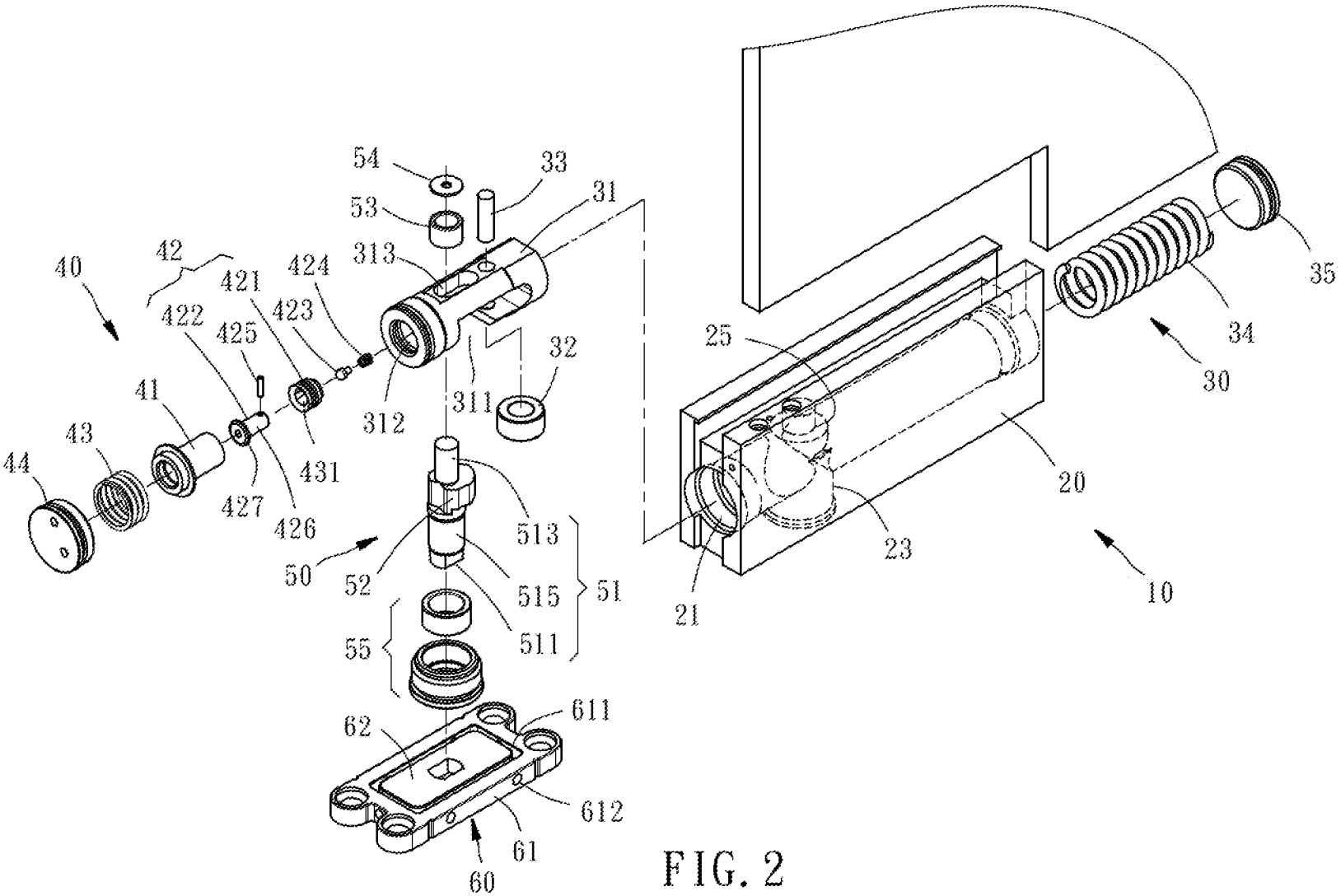
FIG. 2 is an exploded view of the cam type door closer shown in FIG. 1.
Figure 3:
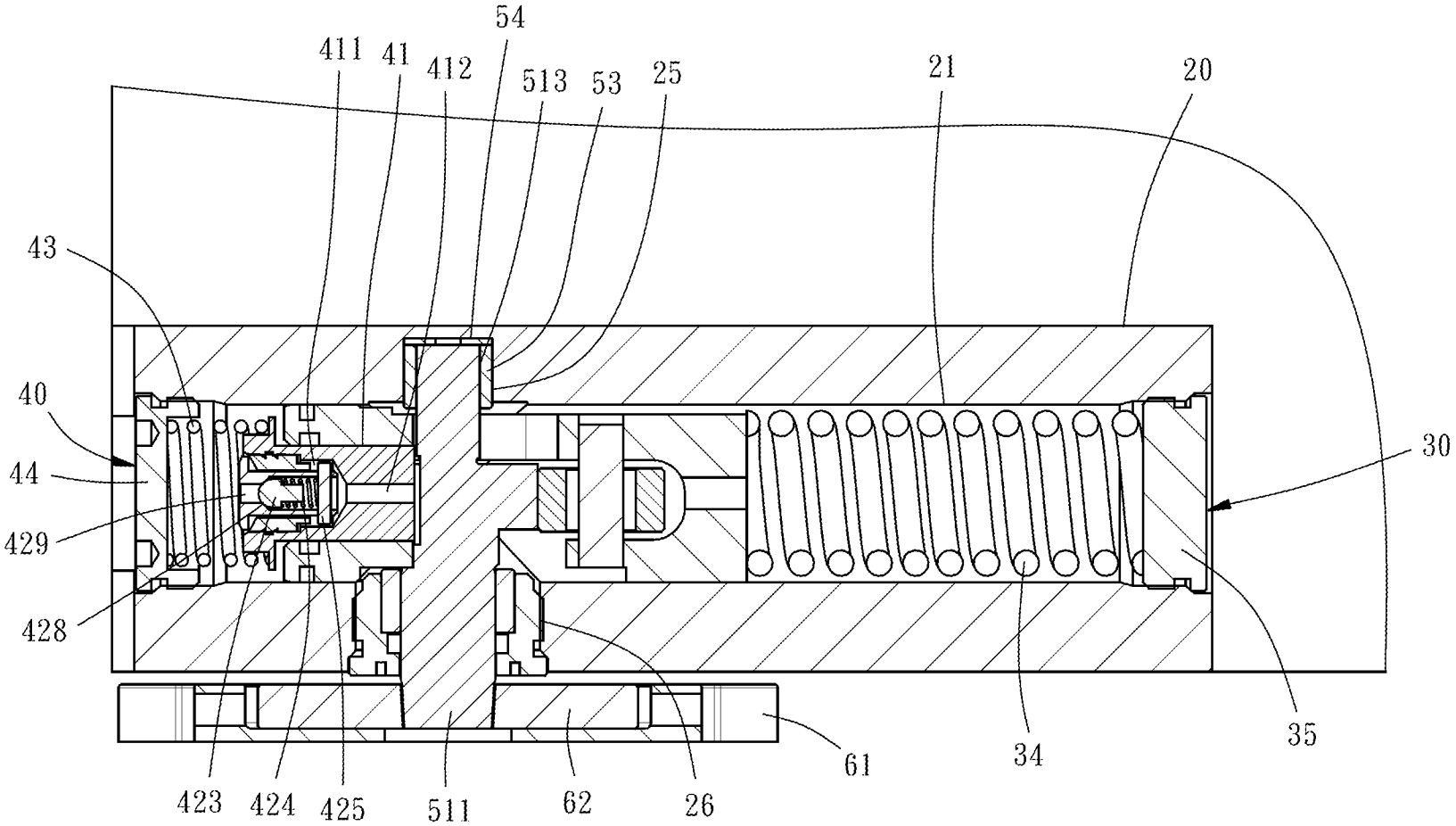
FIG. 3 is a longitudinal sectional view of the cam type door closer shown in FIG. 1.

Referring to FIGS. 1-3, a cam type door closer 10 in accordance with the present invention is shown. The cam type door closer 10 comprises a housing 20, a first piston set 30, a second piston set 40, a drive shaft assembly 50 and a locating block 60.

The housing 20 is an elongated member, having an axial passage 21, a longitudinal passage 23 and a recess 25, which are connected to each other. The axial passage 21 is perpendicular to the longitudinal passage 23. The axial passage 21 runs through two opposite sides of the housing 20. The recess 25 is located above the longitudinal passage 23.

The first piston set 30 is located in one side of the axial passage 21 of the housing 20, comprising a first piston 31, a roller 32, a plug pin 33, a first spring 34 and a first sealing cap 35. The first piston is provided with an open chamber 311, a shaft hole 312 and an elongated slot 313, which are connected to each other. The open chamber 311 is located in the middle of the first piston 31. The shaft hole 312 is at the end of the first piston 31. The elongated slot 313 is located above the open chamber 311. The first spring 34 is mounted in the axial passage 21 of the housing 20 with one end thereof stopped against the first piston 31 and an opposite end thereof stopped against the first sealing cap 35. The first sealing cap 35 is mounted in the housing 20 to seal one end of the axial passage 21.

The second piston set 40 is located in an opposite side of the axial passage 21 of the housing 20, comprising a second piston 41, a gap compensation device 42, a second spring 43 and a second sealing cap 44. The second piston 41 is movably mounted in the shaft hole 312 of the first piston 31. The second piston 41 is provided with a large diameter passage 411 and a small diameter passage 412, which are connected to each other. The gap compensation device 42 is mounted in the large diameter passage 411 of the second piston 41. The second spring 43 is mounted in the axial passage 21 of the housing 20 with one end thereof stopped against the second piston 41, and an opposite end thereof stopped against the second sealing cap 44. The second sealing cap 44 is mounted in the housing 20 to seal the opposite end of the axial passage 21. More specifically, the gap compensation device 42 of the second piston set 40 comprises a locating ring 421, a sleeve 422, a plug 423, an elastic member 424 and a locating pin 425. The locating ring 421 is threaded into the large diameter passage 411 of the second piston 41. The sleeve 422 has a sleeve body 426 and a flange 427 at one end of the sleeve body 426. The sleeve body 426 is inserted through the locating ring 421. The flange 427 is stopped at an end edge of the locating ring 421. The sleeve body 426 of the sleeve 422 is provided with an accommodating space 428 and a small passage 429 in coaxial communication relationship. The plug 423 and the elastic member 424 are sequentially disposed on the accommodating space 428 of the sleeve body 426. The plug 423 has one end thereof facing toward the small passage 429 of the sleeve body 426, and an opposite end thereof stopped against the elastic member 424. The locating pin 425 is placed on the sleeve body 426 and passes through the accommodating space 428 to abut the elastic member 424.

Figure 4:
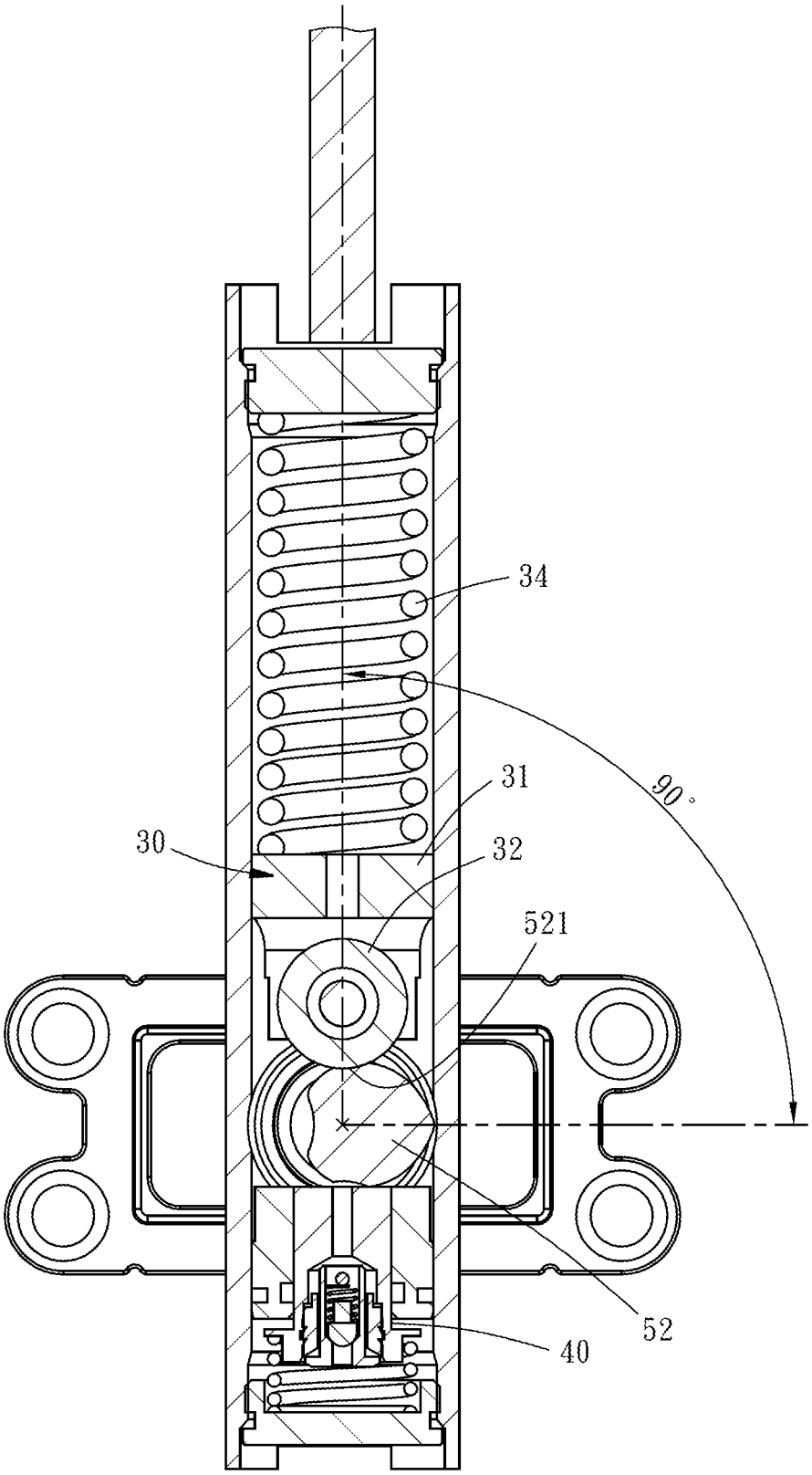
FIG. 4 is a schematic drawing of the present invention, illustrating the status of the cam type door closer when the glass door is opened 90 degrees to the left.
Figure 5:
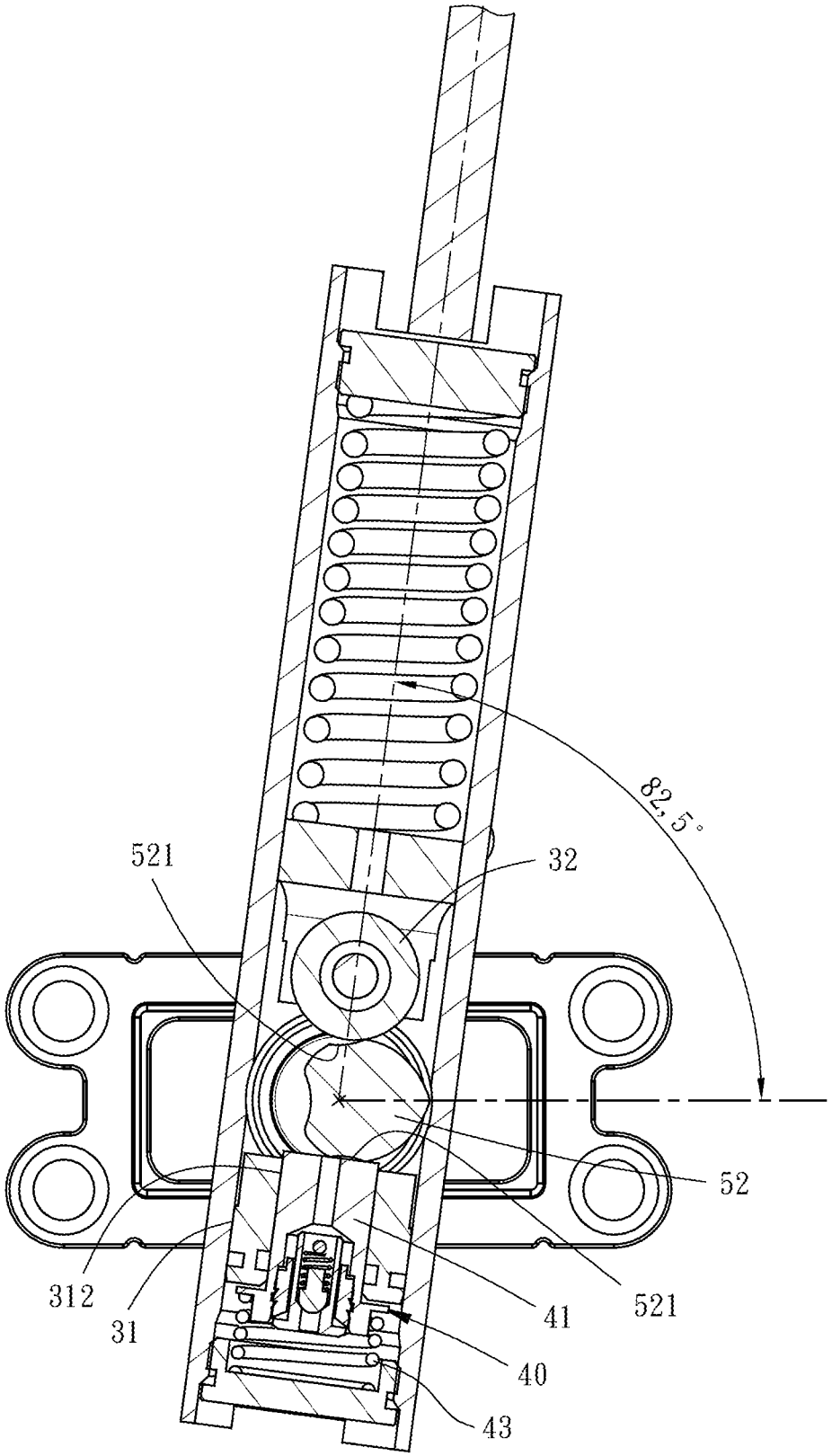
FIG. 5 corresponds to FIG. 4, illustrating the status of the cam type door closer when the glass door is pivoted to 82.5 degree angles.
Figure 6:
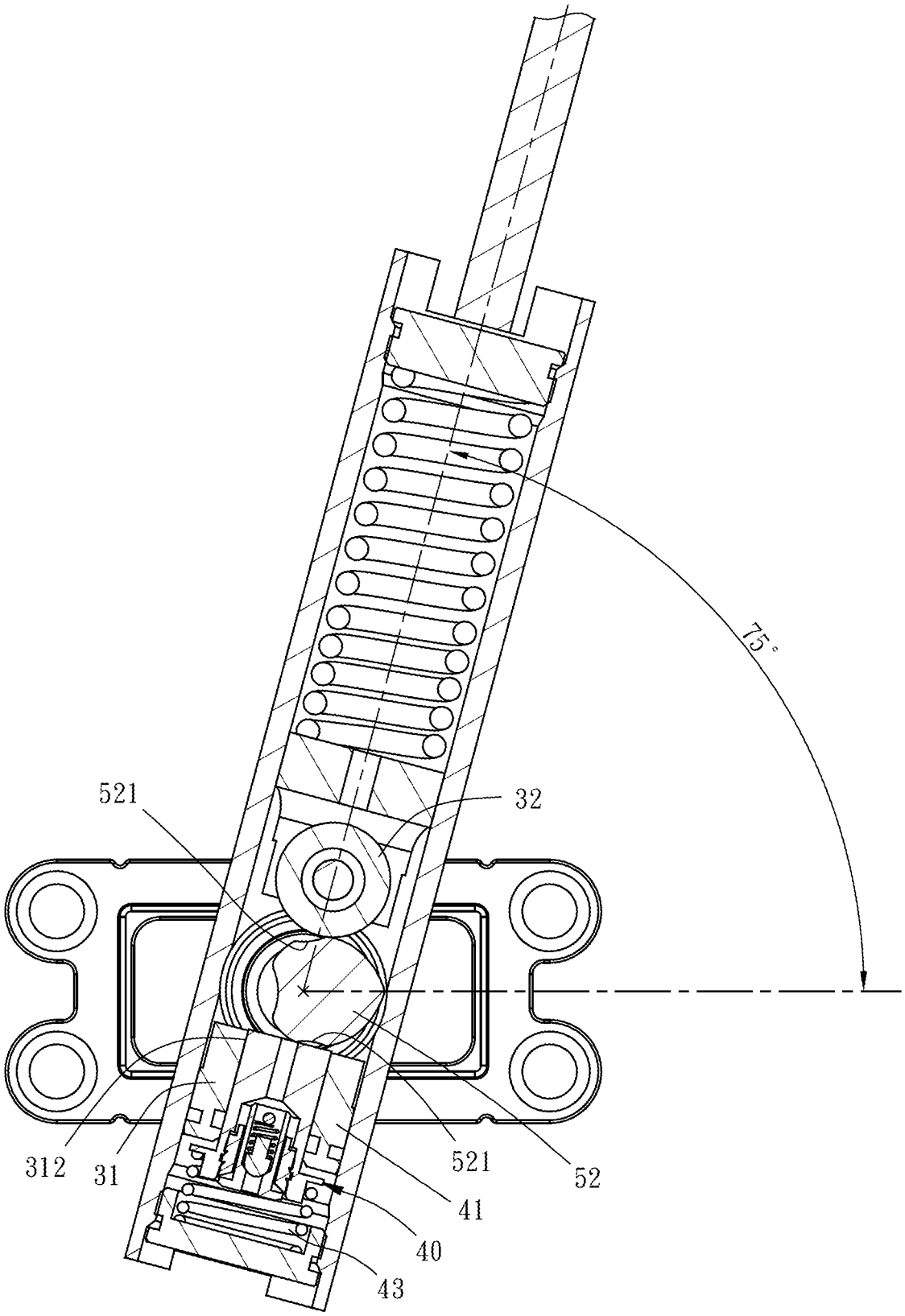
FIG. 6 corresponds to FIG. 5, illustrating the status of the cam type door closer when the glass door is pivoted to 75 degree angles.
Figure 7:
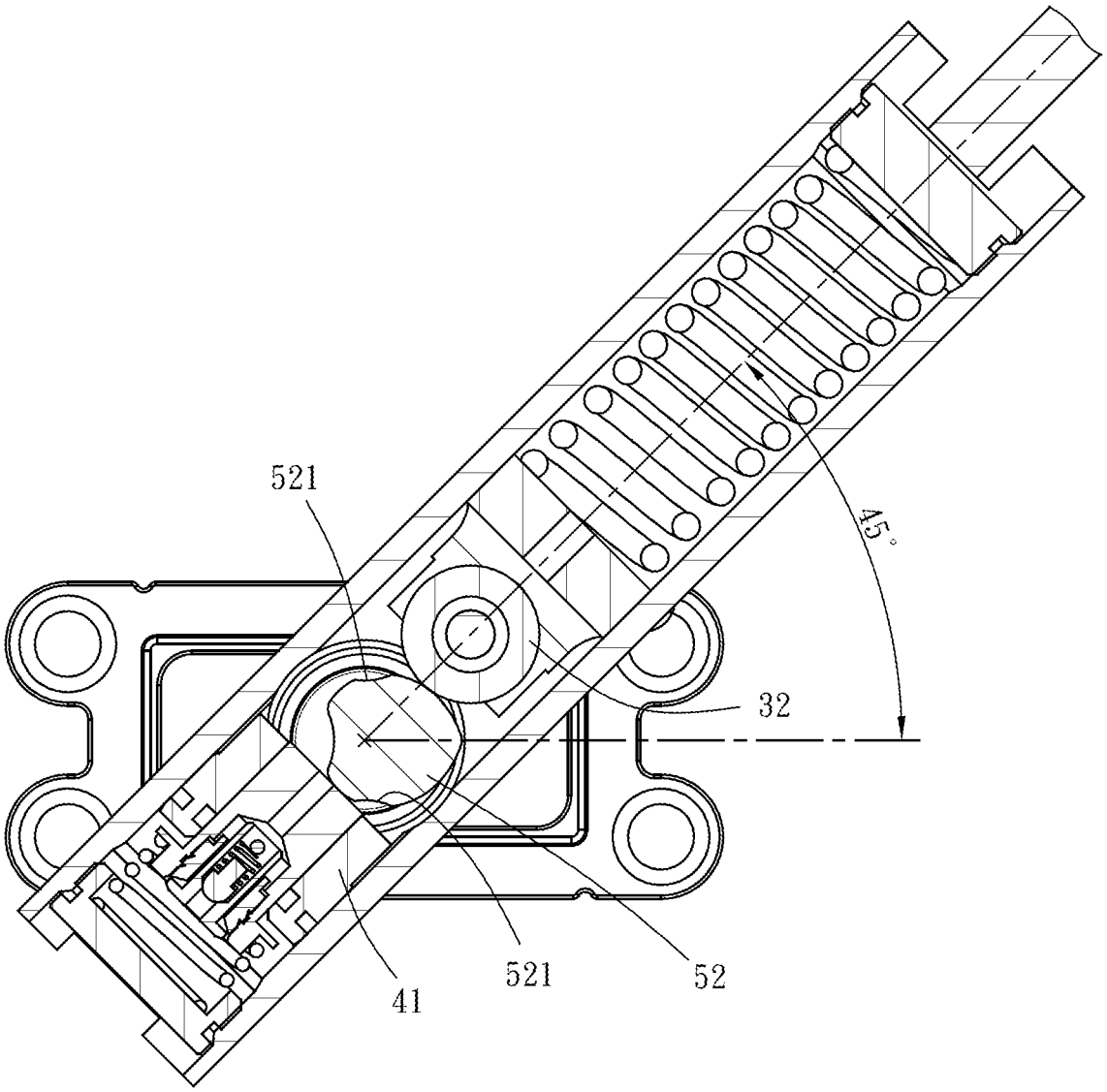
FIG. 7 corresponds to FIG. 6, illustrating the status of the cam type door closer when the glass door is pivoted to 45 degree angles.
Figure 8:
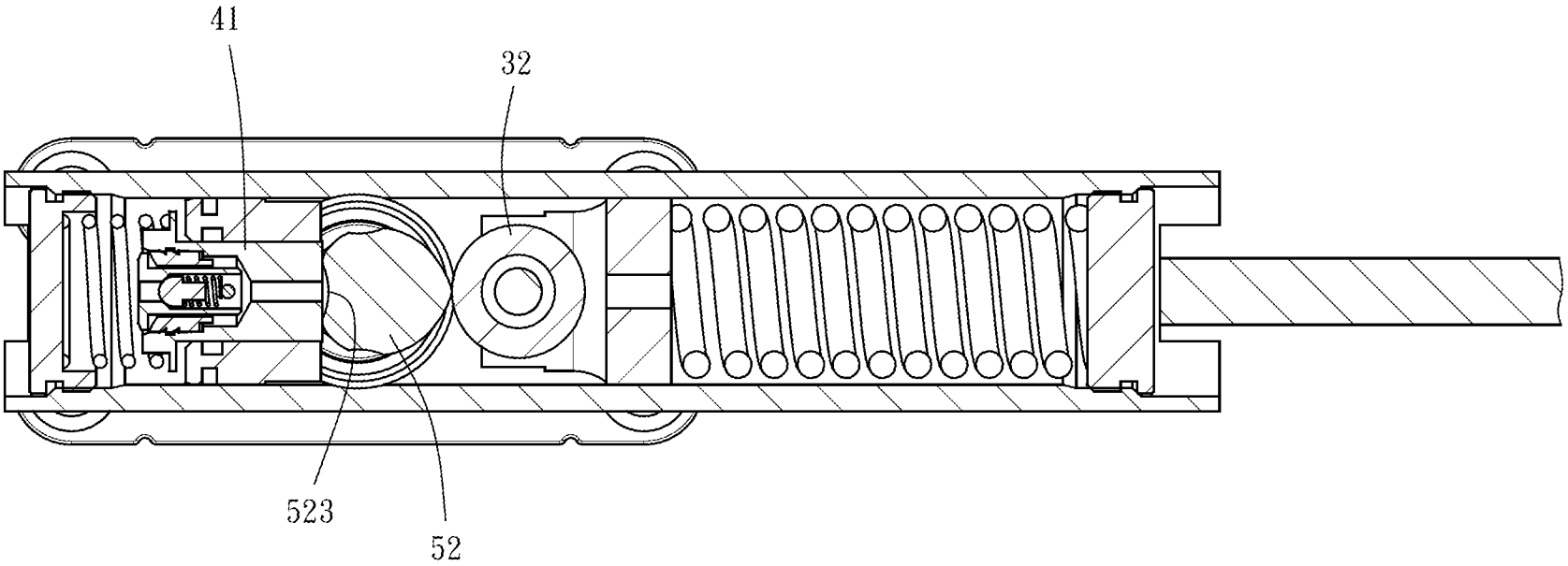
FIG. 8 corresponds to FIG. 7. Illustrating the status of the cam type door closer when the glass door is closed.

The drive shaft assembly 50 is rotatably inserted through the longitudinal passage 23 of the housing 20, comprising a shaft 51, an eccentric cam 52, an upper bushing 53, a gasket 54 and a lower bushing set 55. The shaft 51 has a latching segment 511, a connecting segment 513 and a transition segment 515 between the latching segment 511 and the connecting segment 513. The eccentric cam 52 is located between the transition segment 515 and connecting segment 513 of the shaft 51 within the open chamber 311 of the first piston 31. Further, the eccentric cam 52 is a symmetrical structure, having a positioning groove 521 at each of two opposite sides thereof and a concave arc portion 523 between the two positioning groove 521. When the housing 20 is turned to a first predetermined pivot angle (the door is opened 90 degrees to the left as shown in FIG. 4), the roller 32 of the first piston set 30 is positioned in one positioning groove 521. When the housing 20 is turned to a second predetermined pivot angle (the door is opened 82.6 degrees or 75 degrees to the left as shown in FIG. 5 or FIG. 6), the second piston 41 of the second piston set 40 is positioned in the other positioning groove 421. When the housing 20 is turned to a third predetermined pivot angle (the door gradually changes from 45 degrees to 0 degrees as shown in FIG. 7 and FIG. 8), the second piston 41 of the second piston set 40 is stopped at the concave arc portion 523. The upper bushing 53 and the gasket 54 are mounted in the recess 25 of the housing 20. The connecting segment 513 of the shaft 51 is inserted through the elongated slot 313 of the first piston 31 into the inside of the upper bushing 53. The lower bushing set 55 is mounted on the transition segment 515 of the shaft 51. The eccentric cam 52 has one side thereof stopped against the roller 32 of the first piston set 30, and the other side thereof stopped against the second piston 41 of the second piston set 40.

The locating block 60 comprises a mounting plate 61, a plurality of adjusting members (not shown) and an adjustment plate 62. The mounting plate 61 is fixed on the floor and provided with an accommodation chamber 611, and a plurality of adjusting holes 612 are formed on the outer peripheral surface thereof to communicate with the accommodation chamber 611. Each adjusting member is movably mounted in one respective adjusting hole 612. The adjustment plate 62 is mounted in the accommodation chamber 611 of the mounting plate 61 and connected with the latching segment 511 of the shaft 51 of the drive shaft assembly 50 and can be moved relative to the mounting plate 61 by the abutment of the adjusting members.

Please refer to FIG. 4 to FIG. 8. FIG. 4 shows that when the glass door is opened 90 degrees to the left, the roller 32 of the first piston set 30 is forced by the first spring 34 to push the first piston 31 into abutment against the positioning groove 521 of the eccentric cam 52, and thus, the glass door is positioned at an open position of 90 degrees. When the user performs the door closing action, as shown in FIG. 5 and FIG. 6, the glass door is opened to 82.5 degrees and 75 degrees to the left, and the roller 32 will gradually disengage from the positioning of the positioning groove 521. In order to prevent the glass door from closing quickly at this stage, the second piston 41 of the second piston set 40 will be pushed by the second spring 43 and will protrude into the shaft hole 312 of the first piston 31. At the same time, the second piston 41 of the second piston set 40 will continuously apply pressure to the eccentric cam 52 to slow down the door closing speed of 90 degrees to 75 degrees. More precisely, the second piston 41 is stopped against the positioning groove 521 of the eccentric cam 52 so as to control the closing speed of the pivoting angle of the glass door from 90 degrees to 75 degrees. As shown in FIG. 7, when the glass door is gradually pivoted to 45 degrees, the roller 32 and the second piston 41 are respectively separated from the respective positioning grooves 521. Since the roller 32 and the second piston 41 are simultaneously pressed to the eccentric cam 52 at this time, the closing speed of the glass door can be effectively controlled before the glass door is gradually pivoted from 75 degrees to 0 degrees. Finally, when the glass door is pivoted to 0 degrees as shown in FIG. 8, the second piston 41 is stopped against the concave arc portion 523 of the eccentric cam 52 and the roller 32 is stopped at the top side of the eccentric cam 52 opposite to the concave arc portion 523, allowing the glass door to be stably positioned at 0 degrees.

In summary, when the user closes the glass door, the first spring 34 of the first piston set 30 and the second spring 43 of the second piston set 40 will provide moderate pressure to the first piston 31 and the second piston 41 respectively, enabling the roller 32 and the second piston 41 to provide resistance to the eccentric cam 52 of the drive shaft assembly 50 in the whole door closing process, so that the door closing speed of the glass door can be controlled at all times. This can effectively overcome the damage of the internal components of the door closer when the glass door is pivoted from 90 degrees to 75 degrees.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A cam type door closer, comprising:

a housing comprising an axial passage and a longitudinal passage in communication with said axial passage, said axial passage being perpendicular to said longitudinal passage, said axial passage running through two opposite sides of said housing;

a first piston set mounted in said axial passage of said housing, said first piston set comprising a first piston, a roller, a plug pin, a first spring and a first sealing cap, said first piston comprising an open chamber, a shaft hole and an elongated slot respectively disposed in communication with each other, said open chamber being located in a middle part of said first piston, said shaft hole being located in a distal end of said first piston, said elongated slot being disposed above said open chamber, said first spring being mounted in said axial passage of said housing with one end thereof stopped against said first piston and an opposite end thereof stopped against said first sealing cap, said first sealing cap being mounted in said housing to seal one end of said axial passage;

a second piston set mounted in said axial passage of said housing, said second piston set comprising a second piston, a gap compensation device, a second spring and a second sealing cap, said second piston being movably mounted in said shaft hole of said first piston, said second piston comprising a large diameter passage and a small diameter passage in communication with each other, said gap compensation device being mounted in said large diameter passage of said second piston, said second spring being mounted in said axial passage of said housing with one end thereof stopped against said second piston and an opposite end thereof stopped against said second sealing cap, said second sealing cap being mounted in said housing to seal an opposite end of said axial passage; and a drive shaft assembly rotatably inserted into said longitudinal passage of said housing, said drive shaft assembly comprising a shaft and an eccentric cam, said eccentric cam being located on said shaft with one side thereof stopped against said roller of said first piston set and an opposite side thereof stopped against said second piston of said second piston set, wherein one end of said second piston has a contact flat surface and said contact flat surface of said second piston is stopped against said eccentric cam.

2. The cam type door closer as claimed in claim 1, wherein said housing further comprises a recess located above said longitudinal passage; said shaft comprises a latching segment, a connecting segment and a transition segment between said latching segment and said connecting segment; said eccentric cam is mounted on said shaft between said transition segment and said connecting segment within said open chamber of said first piston, said connecting segment of said shaft being inserted through said elongated slot of said first piston into said recess of said housing.

3. The cam type door closer as claimed in claim 2, wherein said drive shaft assembly further comprises an upper bushing, a gasket and a lower bushing set, said upper bushing and said gasket being mounted in said recess of said housing, said connecting segment of said shaft being inserted into said upper bushing, said lower bushing set being mounted on said transition segment of said shaft.

4. The cam type door closer as claimed in claim 1, wherein said gap compensation device of said second piston set comprises a locating ring, a sleeve, a plug, an elastic member and a locating pin, said locating ring being threaded into said large diameter passage of said second piston, said sleeve comprising a sleeve body and a flange at a distal end of said sleeve body, said sleeve body being inserted into said locating ring, said flange being stopped at an end edge of said locating ring, said sleeve body of said sleeve comprising an accommodating space and a small passage coaxially communicated with each other, said plug and said elastic member being sequentially mounted in said accommodating space of said sleeve body, said plug having one end thereof facing toward said small passage of said sleeve body and an opposite end thereof stopped against said elastic member, said locating pin being inserted into said sleeve body to pass through said accommodating space for stopping said elastic member.

5. The cam type door closer as claimed in claim 1, wherein said eccentric cam comprises two positioning grooves, one said positioning groove being adapted for stopping against said roller of said first piston set when said housing is biased to a first predetermined pivot angle, the other said positioning groove being adapted for stopping against said second piston of said second piston set when said housing is biased to a second predetermined pivot angle.

6. The cam type door closer as claimed in claim 1, wherein said eccentric cam comprises a concave arc portion adapted for stopping against said second piston of said second piston set when said housing is biased to a predetermined pivot angle.

7. The cam type door closer as claimed in claim 1, further comprising a locating block, said locating block comprising a mounting plate, a plurality of adjusting members and an adjustment plate, said mounting plate being affixed to the floor, said mounting plate comprising an accommodation chamber and a plurality of adjusting holes on a peripheral wall thereof in communication with said accommodation chamber, said adjusting members being respectively movably mounted in said adjusting holes, said adjustment plate being mounted in said accommodation chamber of said mounting plate and connected to said shaft of said drive shaft assembly and stoppable by said adjusting members to move relative to said mounting plate.

* * * * *